US005761755A

United States Patent [19]

Huang

[11] Patent Number: 5,761,755

[45] Date of Patent: Jun. 9, 1998

[54] FOLDABLE DEVICES FOR A CRIB FRAME ASSEMBLY

[76] Inventor: Li-chu Chen Huang, No. 99, Fuchou 7th St., Chiayi City, Taiwan

[21] Appl. No.: 832,272

[22] Filed: Apr. 3, 1997

[51] Int. Cl.[6] ..... A47D 7/00; E05D 11/10; F16C 11/10

[52] U.S. Cl. ..... 5/99.1; 5/98.1; 16/324; 16/348; 16/357; 403/102; 403/325

[58] Field of Search ..... 5/98.1, 99.1; 16/324, 16/348, 357; 403/65, 102, 117, 325

[56] References Cited

U.S. PATENT DOCUMENTS

| | | | |
|---|---|---|---|
| 5,211,498 | 5/1993 | Huang | 5/99.1 |
| 5,454,124 | 10/1995 | Huang | 5/98.1 |
| 5,483,710 | 1/1996 | Chan | 5/99.1 |
| 5,542,134 | 8/1996 | Wang | 5/99.1 |
| 5,581,827 | 12/1996 | Fong et al. | 5/99.1 |

*Primary Examiner*—Steven N. Meyers
*Assistant Examiner*—Robert G. Santos
*Attorney, Agent, or Firm*—Holland & Hart LLP

[57] ABSTRACT

A crib having a number of upper rods, lower rods and poles securely connected therebetween. The crib is further provided with foldable devices each pivotally connected between two distal ends of the upper rods, plates each pivotally receiving the other two distal ends of said upper rods and securely receiving a distal end of the pole, seats each securely receiving the other end of the pole and pivotally receiving two distal ends of the lower rods, pivoting blocks each pivotally receiving the other two distal ends of said lower rods and a cover enclosing all of the upper rods, the poles and the lower rods and provided with a handle disposed thereon, such that a user is able to fold the crib by lifting upward the handle of the cover after the foldable devices are activated by the user.

3 Claims, 8 Drawing Sheets

FOLDABLE DEVICES FOR A CRIB FRAME ASSEMBLY

FIELD OF THE INVENTION

The present invention generally relates to a crib, and more particularly to a crib which is safe in structure for a baby to play therein and able to be folded easily by a user.

BACKGROUND OF THE INVENTION

Cribs usually made of wood or other substantial materials provide a safe environment for babies to play or stay therein. With such a crib, parents are able to put their babies in the crib, and do whatever they want to do without worrying whether accidents might happen and the babies be hurt. Yet, this kind of crib is large in size and is not easy to be moved, although some cribs do have wheels mounted thereto to facilitate the mobility thereof. When parents are having a picnic or trying to have a relaxing outdoors, it is not easy for them to spend time together, because one of them will always be busy looking after their baby. In order to allow the adult to have some private time and space when having an outdoor activity, a light weight crib which is small in size is brought to the market. The crib has a set of upper rods, a set of lower rods, a plurality of poles pivotally connected between the upper and lower rods and a soft, resilient material enclosing the whole crib, whereby a space is defined for babies to stay therein. The light weight, movability characteristics of the crib provide convenience to parents. Parents will still have their private time and space when taking an outdoor activity, because parents can take the crib along with them and the crib will therefore provide a safe environment for the babies and thus parents won't have to spend too much time taking care of the babies.

Such a crib is easily carried along and provides great convenience to parents, but it still suffers some disadvantages. The crib needs at least two persons to fold it and it still takes up too much space when folded. Since this type of crib is mainly used outdoors, therefore it has to be able to be put into the trunk of a car and that causes the size thereof to be a major concern to users.

From the previous description, the cribs currently available in the market which require at least two persons to fold will not fulfill the needs of users and improvements or alternations thereof are thus required. A crib having a foldable device mounted thereto and constructed in accordance with the present invention tends to mitigate and/or obviate the aforementioned problems.

SUMMARY OF THE INVENTION

The main objective of the invention is to provide a crib having a set of upper rods, a set of lower rods and a plurality of poles pivotally connected between the upper and lower rods. The upper rods and the lower rods each form a rectangular frame, so that the set of upper rods has four sides and the set of the lower rods also has four sides respectively aligned with the four sides of the upper rods. Each upper rod has a first distal end and a second distal end and a foldable device is pivotally connected between two respective first ends thereof. A plate defining therein a space for pivotally receiving respective second ends of two upper rods is mounted onto a pole securely connected with the lower rods via a seat. The seat further defines therein two respective compartments for pivotally receiving two second distal ends of two respective lower rods. A pivoting block is pivotally connected between two respective first distal ends of two respective lower rods. With a configuration as previously described, the upper rods and the lower rods of the crib are able to be folded from the respective first ends.

Another objective of the invention is to provide a crib which is able to be folded by a single hand. The crib is further provided with a cover which encloses the upper rods, the poles and the lower rods and has a handle securely connected to a surface thereof. A user is able to fold the upper rods via the foldable device by grasping the handle and lifting it upward, whereby the lower rods will thus be driven to move along with the upward motion of the cover and will cluster toward the center of the crib due to the pivotal connection of the upper rods and the lower rods.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
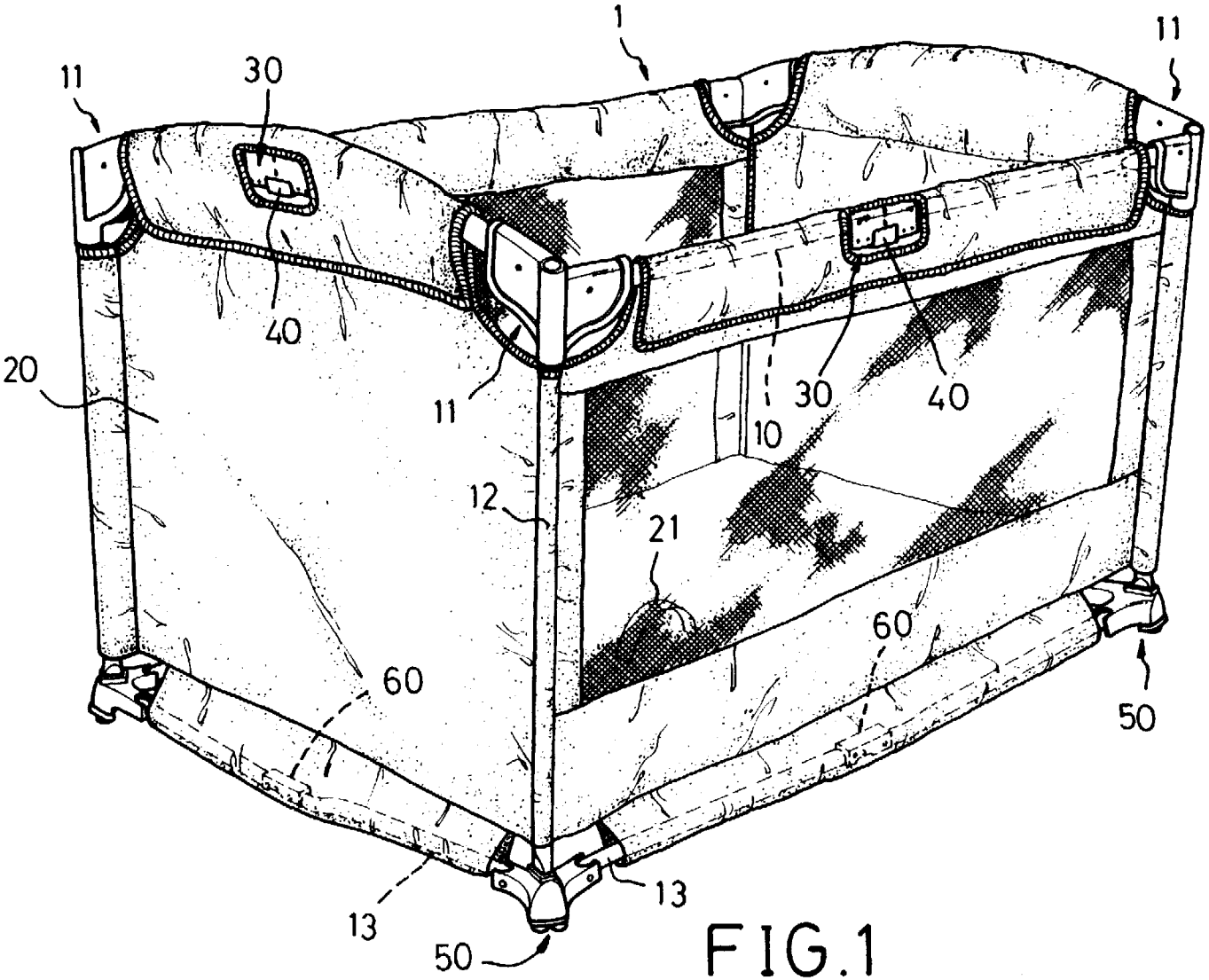
FIG. 1 is a perspective view of a crib constructed in accordance with the present invention.
Figure 2:
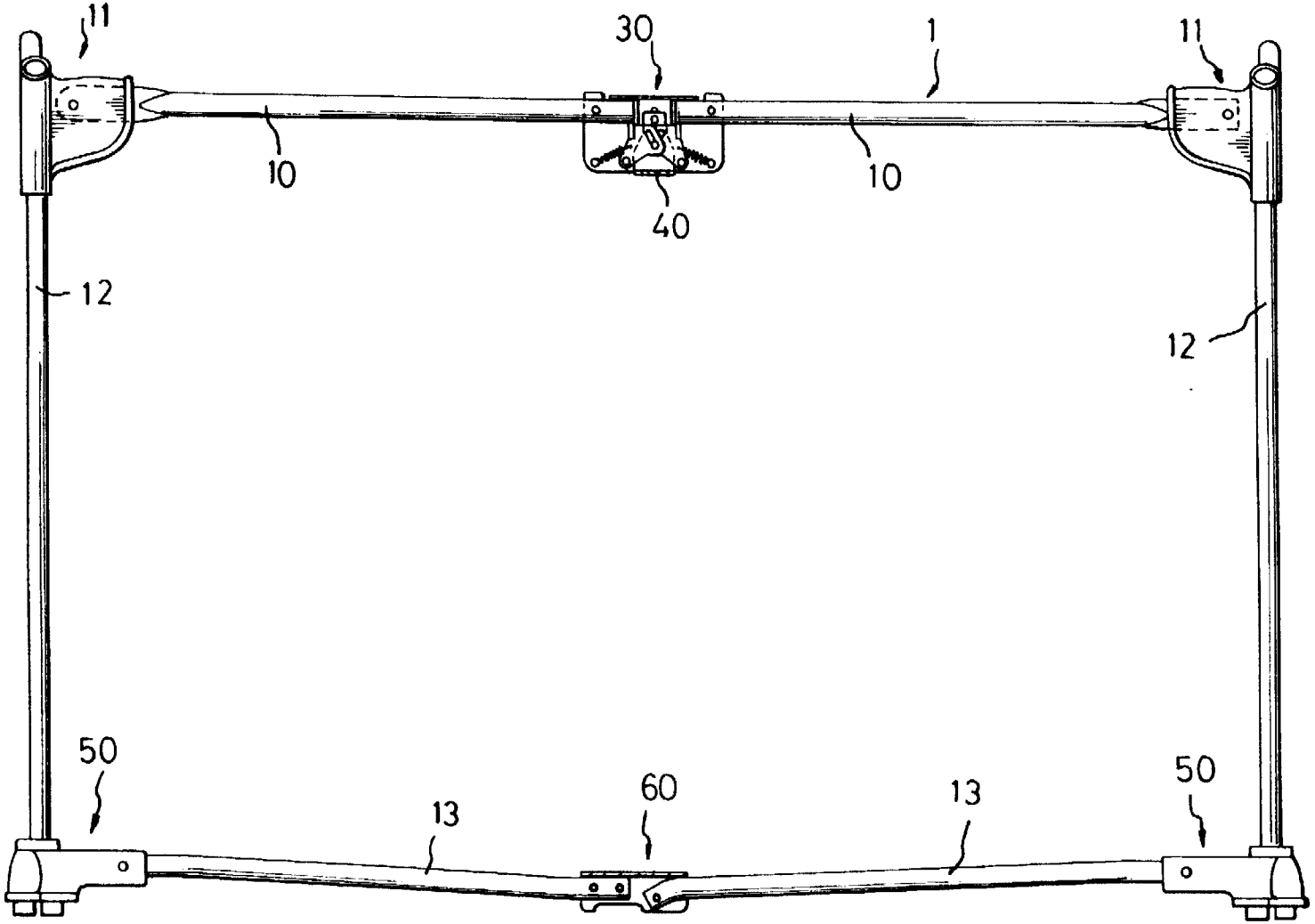
FIG. 2 is a side view of the crib after removing a cover thereof.

Referring to FIGS. 1 and 2, one preferred embodiment of a crib 1 constructed in accordance with the present invention is shown. The crib 1 comprises a set of upper rods 10, a set of lower rods 13 and a plurality of poles 12 fixedly connected between the upper rods 10 via a plate 11 and the lower rods 13 via a seat 50. Each upper rod 10 and lower rod 13 respectively has a first distal end and a second distal end (not numbered). A foldable device 30 is pivotally connected between two respective first distal ends of two upper rods 10 and the respective second distal end of the upper rod 10 is pivotally received within a compartment (not numbered) defined in the plate 11, such that the linked upper rods 10 are able to be folded via the foldable device 30. Two first distal ends of the lower rod 13 are respectively and pivotally connected to a pivoting block 60 and two second distal ends of the lower rod 13 are respectively and pivotally received within the seat 50, such that the set of lower rods 13 are able to be folded due to the pivotal connection therebetween. The crib 1 further comprises a cover 20 enclosing the upper rods 10, the poles 12 and the lower rods 13 and has a handle 21 fixedly connected to a surface thereof.

Figure 3:
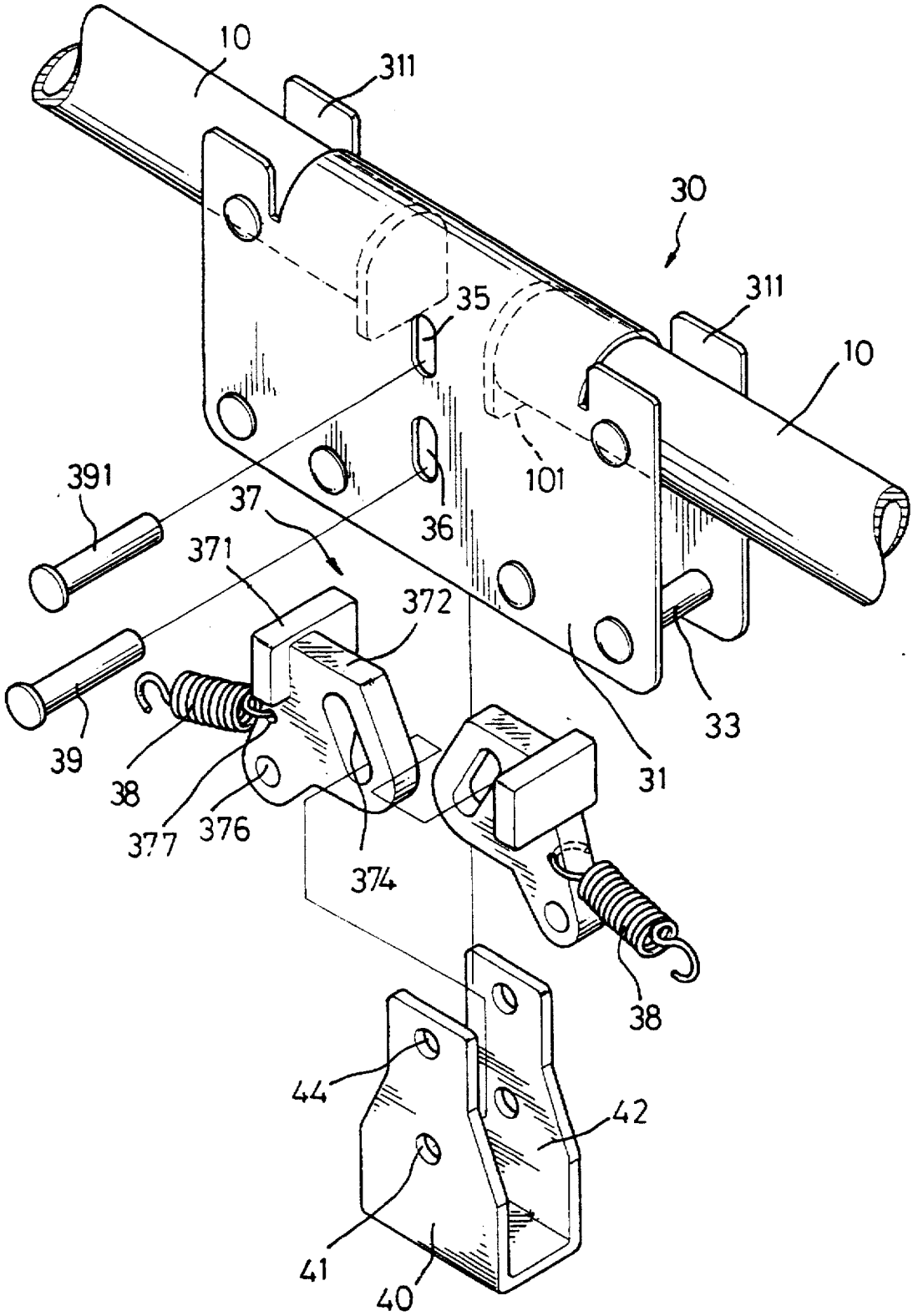
FIG. 3 is an exploded view showing the configuration features of a foldable device.
Figure 4:
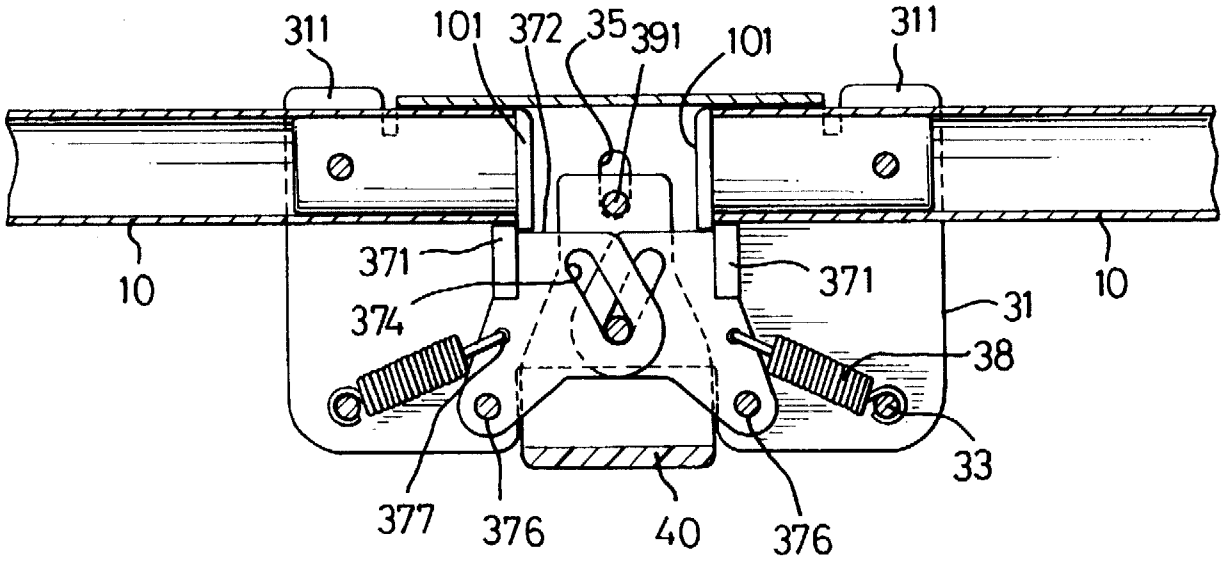
FIG. 4 is a schematic view showing the assembled foldable device with partial cut away.

Referring to FIG. 3, the foldable device 30 comprises a "U" shaped hollow housing 31 having two cutouts 311 defined in a top face thereof, two corresponding controlling blocks 37 each provided with a stop 371, an extension 372 having an inclined slot 374 defined therein, a first hole 376 defined in a bottom face thereof, a second hole 377 defined therein for receiving a recovery device 38, preferably a coil spring, and a press board 40. The housing 31 further has two positioning studs 33 respectively mounted at two ends thereof, a first long hole 35 and a second long hole 36, such that the recovery device 38 is able to be securely connected between the second hole 377 of the controlling block 37 and the positioning stud 33. The press board 40 further defines therein an aligned pair of first through holes 41, an aligned pairs of second through holes 44 and a space 42 for receiving the two controlling blocks 37. When assembled, referring to FIG. 4, the two controlling blocks 37 each having one of the recovery devices 38 connected thereto via the second hole 377 are respectively and securely connected to the positioning rod 33 and riveted onto the housing 31 through the respective first hole 376 and the press board 40 is then inserted into the housing 30 and the two controlling blocks 37 are received within the space 42. In order to secure the press board 40 and the controlling blocks 37 with the housing 31, a first rivet 39 is inserted into the second long hole 36 defined in a first face of the housing 31 and further into the first through holes 41 of the press board 40 and the two aligned inclined slots 374 to be fixedly connected to a second face of the housing 31. A second rivet 391 is then inserted into the first long hole 35 of the housing 31 and the second pair of through holes 44 of the press board 40 to be fixedly connected to the second face of the housing 31. It is noted that a flange 101 is formed on the first distal end of the upper rod 10 and the two controlling blocks 37 are received within the housing 31 and located at a position such that the respective flange 101 of the respective upper rod 10 is hooked to an edge of the stop 371 of the respective controlling block 37, as shown in FIG. 4.

Figure 5:
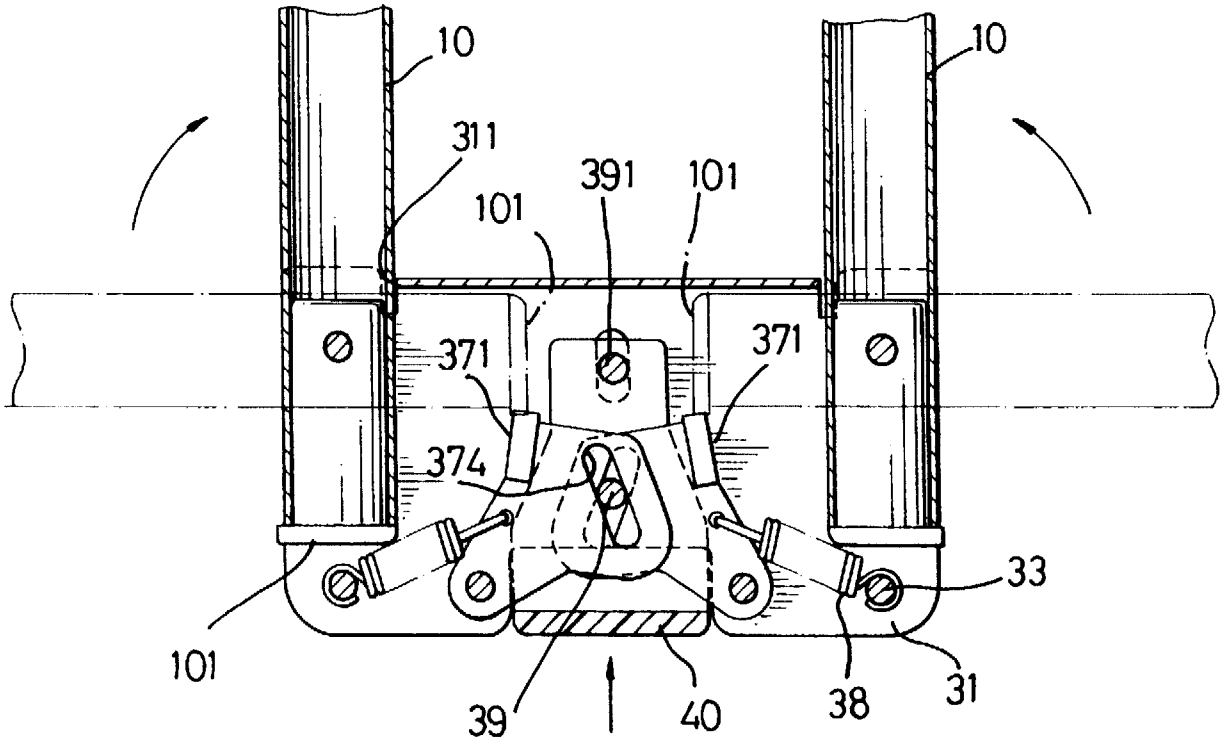
FIG. 5 is still a schematic view showing the movement of the foldable device with partial cut away.

The foldable device 30 is able to cause the two upper rods 10 pivotally connected thereto to be folded when the press board 40 is pushed toward the housing 31. Due to the defining of the first long hole 35 and the second long hole 36, pressing the press board 40 will cause the press board to have a displacement toward and outward of the housing 31. When the press board 40 is pushed toward the housing 31, the two inclined slots 374 of the respective controlling block 37 will be forced to move according to the inclined angle of the inclined slot 374, which will cause the respective controlling block 37 to move to a different direction and the stop 371 of the controlling block 37 will thus disengage with the flange 101 of the first end of the upper rod 10, therefore, the respective upper rod 10 is able to pivot about the housing 31, as shown in FIG. 5.

Figure 6:
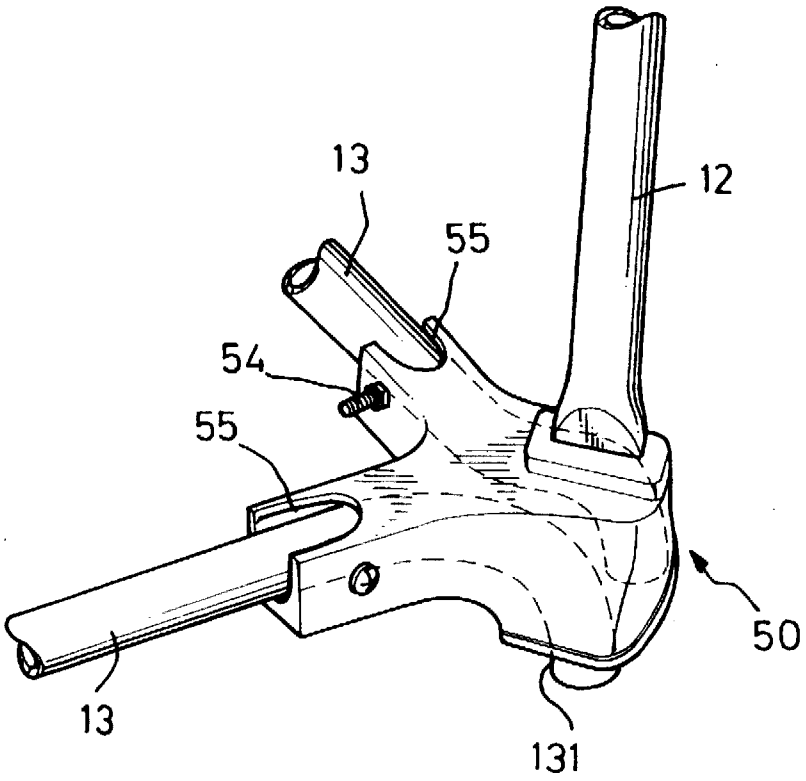
FIG. 6 is a perspective view of a seat.
Figure 8:
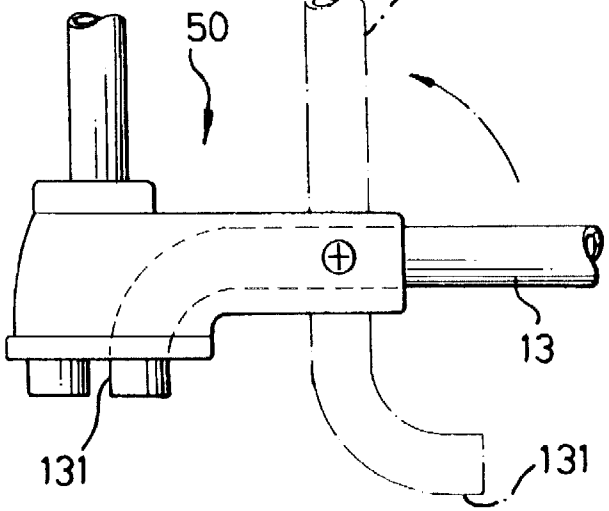
FIG. 8 is a schematic view showing the movement of the seat.
Figure 7:
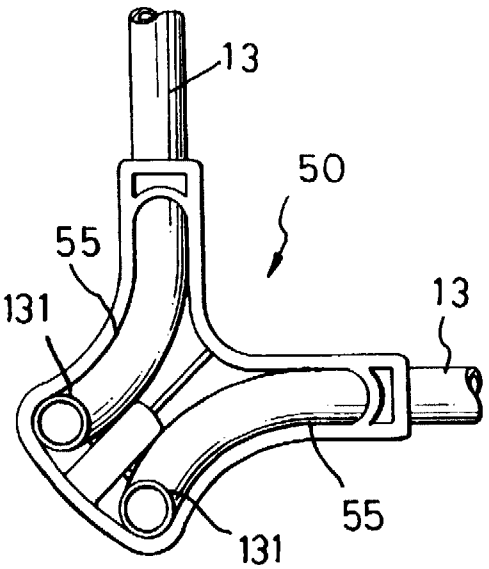
FIG. 7 is a schematic bottom view of the seat.

Referring to FIG. 2 and FIG. 6, the seat 50 has defined therein two compartments 55 for respectively and pivotally receiving two first distal ends 131 of the lower rod 13 and securely receives a second distal end of the pole 12. The plate 11 defines therein a passage (not shown nor numbered) for securely receiving a second distal end of the pole 12. The respective second distal ends of the lower rods 13 are pivotally received in a pivoting block 60. It is also to be noted that the first distal end 131 of each of the lower rods 13 protrudes past the seat 50 and abuts the ground, accordingly a firm support is provided to the crib of the invention. The two compartments 55 of the seat 50 are so defined that the first distal ends 131 of the lower rod 13 are able to pivot about the seat 50 only in one direction, as shown in FIG. 8.

Figure 9:
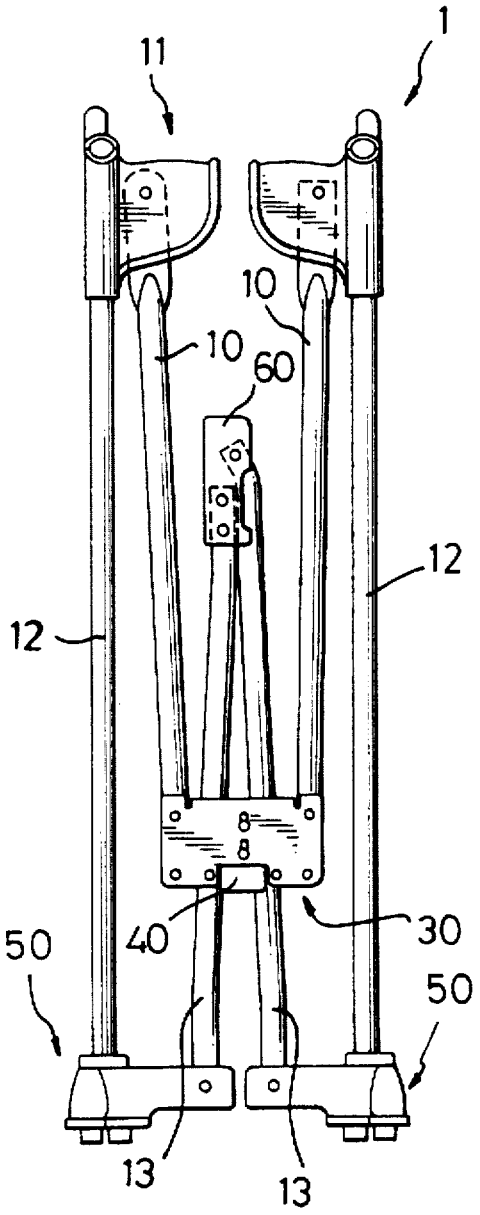
FIG. 9 is a side view of the crib after being folded and removal of the cover.

The crib 1 as previously described is able to be folded when the press board 40 is pushed toward the housing 31 to allow the flange 101 of the respective first distal ends of the upper rods 10 to disengage from the stops 371 of the respective controlling blocks 37 and then the lower rods 13 are able to be folded by a user lifting upward the handle 21 of the cover 20. Referring to FIG. 1 and FIG. 9, because the cover 20 encloses all the upper rods 10, the poles 12 and the lower rods 13, and the lower rods 13 are pivotally connected between the seat 50 and the pivoting block 60, therefore, lifting the handle 21 of the cover 20 will drive the lower rods 13 to move upward, which cooperating the disengagement of the flange 101 with the stop 371, the crib 1 of the invention will be folded as shown in FIG. 9.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A crib comprising a set of upper rod pairs each having a first distal end and a second distal end, a set of lower rod pairs each having a first distal end and a second distal end, a plurality of poles respectively and securely connected with said second distal ends of said upper rods via a plate and with said second distal ends of said lower rods via a seat, a plurality of foldable devices pivotally connected between two first distal ends of said upper rods, more than one pivoting block between each connecting pair of said lower rods and a cover enclosing said upper rods, said poles and said lower rods, wherein the improvements are:

a first distal end of each of said upper rods being provided with a flange;

said foldable devices having:

a housing defining therein two cutouts for pivotally receiving two adjacent first distal ends of said upper rods and having two positioning studs rigidly mounted therein, a first long hole and a second long hole;

two controlling blocks pivotally received within said housing wherein each of said controlling blocks is configured to have a stop engageable with said flange of said upper rod, an extension defining therein an inclined slot and a hole for connecting with an end of a recovery device wherein another end of said recovery device is securely connected with one of said positioning studs;

a press board movably received within said housing and defining therein a space for receiving said two controlling blocks therein, and a first through hole and a second through hole corresponding to said first long hole and said second long hole;

a first retainer extending through said first long hole of said housing and said second through hole of said press board to securely mount said press board onto said housing;

a second retainer extending through said second long hole of said housing, said first through hole of said press board and two said inclined slots partly aligned together and mounted to a face of said housing;

said seat having a distal end of one of said poles securely received therein and being defined therein two compartments for pivotally receiving two second distal ends of said lower rods.

2. The crib as claimed in claim 1, wherein said recovery device is a coil spring.

3. The crib as claimed in claim 1 further comprising a handle mounted at a predetermined position of said cover.

* * * * *